US010407852B2

(12) United States Patent
Dickinson et al.

(10) Patent No.: US 10,407,852 B2
(45) Date of Patent: Sep. 10, 2019

(54) PORTABLE BOLLARD AND BARRICADE SYSTEM

(71) Applicant: Delta Scientific Corporation, Palmdale, CA (US)

(72) Inventors: Harry D. Dickinson, La Canada Flintridge, CA (US); David G. Dickinson, La Canada Flintridge, CA (US); James John Burnett, Canyon Country, CA (US)

(73) Assignee: DELTA SCIENTIFIC CORPORATION, Palmdale, CA (US)

( * ) Notice: Subject to any disclaimer, the term of this patent is extended or adjusted under 35 U.S.C. 154(b) by 0 days.

(21) Appl. No.: 15/807,520

(22) Filed: Nov. 8, 2017

(65) Prior Publication Data

US 2019/0136470 A1 May 9, 2019

(51) Int. Cl.

| | |
|---|---|
| ***E01F 13/02*** | (2006.01) |
| ***E01F 13/12*** | (2006.01) |
| ***F41H 11/08*** | (2006.01) |

(52) U.S. Cl.

CPC ..... *E01F 13/02* (2013.01); *E01F 13/12* (2013.01); *F41H 11/08* (2013.01)

(58) Field of Classification Search

CPC ..... E01F 13/02; E01F 13/12; E01F 13/022; E01F 13/024; E01F 13/026; E01F 13/028; E01F 9/688; E01F 9/654; E01F 9/553; E01F 9/535; E01F 9/559

See application file for complete search history.

(56) References Cited

U.S. PATENT DOCUMENTS

| | | | | |
|---|---|---|---|---|
| 19,724 | A * | 3/1858 | Seekins | E01F 13/02 256/64 |
| 3,856,268 | A | 12/1974 | Fitch | |
| 5,011,106 | A * | 4/1991 | Cody | A62B 35/0068 182/3 |
| 7,048,090 | B2 * | 5/2006 | Dean | A62B 35/0056 182/3 |
| 7,077,237 | B1 * | 7/2006 | Haake | E04G 5/14 182/113 |
| 7,722,283 | B2 * | 5/2010 | Siu | E01F 9/623 404/6 |

(Continued)

FOREIGN PATENT DOCUMENTS

| | | |
|---|---|---|
| KR | 2011 0005198 A | 1/2011 |
| WO | WO 00/75432 A1 | 12/2000 |

OTHER PUBLICATIONS

Delta Scientific Corp., "DSC700/800 Series—Protect your Facility and its Aesthetics!" Pamphlet, printed in 2014, 4 pages.

Delta Scientific Corp., "DSC501—Advanced Highest Security, High Duty Cycle Counter-Terrorist Protection!" Pamphlet, printed in 2014, 4 pages.

Delta Scientific Corp., "Portable Crash Barriers 4 models / 2 versions—Hundreds in use throughout the world" Pamphlet, printed in 2014, 4 pages.

(Continued)

*Primary Examiner* — Abigail A Risic

(74) *Attorney, Agent, or Firm* — Lewis Roca Rothgerber Christie LLP

(57) ABSTRACT

A portable bollard for arresting motion of a vehicle includes a post, a base plate coupled to the post, a top plate coupled to the post and spaced apart from the base plate along a length of the post, and a tapered member extending from a surface of the top plate facing the base plate to the post. The tapered member tapers from a wider end at the surface of the top plate to a narrower end at the post. The top plate is rotationally offset from the base plate.

24 Claims, 8 Drawing Sheets

(56) References Cited

U.S. PATENT DOCUMENTS

| | | | | |
|---|---|---|---|---|
| 8,087,846 | B2 * | 1/2012 | Ringelberg | E01F 13/028 404/6 |
| 8,684,571 | B1 | 4/2014 | Alaura et al. | |
| 9,010,487 | B2 * | 4/2015 | Cruz | E04G 21/3276 182/3 |
| D772,040 | S * | 11/2016 | Grant | D8/354 |
| 9,561,731 | B2 * | 2/2017 | Johnson | B60L 11/1824 |
| 2001/0032435 | A1 * | 10/2001 | Austin | A62B 35/0087 52/749.12 |
| 2002/0100636 | A1 * | 8/2002 | Cole | A62B 35/0068 182/113 |
| 2006/0219153 | A1 * | 10/2006 | Tipaldo | E01F 9/688 116/63 C |
| 2007/0086858 | A1 * | 4/2007 | Morgan | E01F 13/12 404/6 |
| 2008/0038056 | A1 * | 2/2008 | Patel | E01F 13/12 404/6 |
| 2008/0112756 | A1 * | 5/2008 | Omar | E01F 13/12 404/9 |
| 2009/0028638 | A1 * | 1/2009 | Crawford | E01F 13/12 404/6 |
| 2009/0250674 | A1 * | 10/2009 | Darcy | E01F 13/12 256/13.1 |
| 2010/0232876 | A1 * | 9/2010 | Ringelberg | E01F 13/028 404/6 |
| 2013/0183090 | A1 | 7/2013 | Burton | |
| 2013/0213897 | A1 * | 8/2013 | Jauncey | E02B 15/046 210/747.6 |
| 2014/0017003 | A1 * | 1/2014 | Ball | E01F 13/12 404/6 |
| 2015/0041744 | A1 * | 2/2015 | Higgs | E01F 13/022 256/65.01 |
| 2017/0009412 | A1 * | 1/2017 | Eaton | E01F 13/028 |
| 2017/0129356 | A1 * | 5/2017 | Johnson | B60L 11/1825 |

OTHER PUBLICATIONS

Delta Scientific Corp., "DSC7000 Series—Active Beam Barricades for Wide Roadways that Must Be Secured!" Pamphlet, printed in 2014, 4 pages.

Delta Scientific Corp., "Delta Anti-Terrorist & Vehicle Control Equipment" Pamphlet, printed in 2014, 8 pages.

Delta Scientific Corp., "Automated Traffic Control From the Company that Created the Concept" Pamphlet, printed in 2016, 8 pages.

Delta Scientific Corp., "Crash-Rated High Security Sliding Gates—Cantilever, Linear Tracked & Decorative" Pamphlet, printed in 2017, 4 pages.

Delta Scientific Corp., "Bullet-resistant guard booths provide unmatched protection—and keep unwanted visitors out!" Leaflet, printed in 2017, 6 pages.

Delta Scientific Corp., "DSC207 Shallow Foundation Wedge Barricade with Covered Front & Sides" Leaflet, printed in 2017, 2 pages.

Delta Scientific Corp., "DSC1200—Plug-and-Pay High Security Vehicle Access Control" Leaflet, printed in 2017, 2 pages.

Delta Scientific Corp., "DSC2000—Breakthrough High-speed, High-security Barricade with Minimal Foundation!" Pamphlet, printed in 2017, 4 pages.

Delta Scientific Corp., "Crash-Rated Cable & Chain Beam Barriers" Pamphlet, printed in 2017, 4 pages.

Delta Scientific Corp., "DSC600 Series—New Crash-Resistant Fixed Bollard Modules Protect Facilities from Terrorist & Errant Vehicles" Pamphlet, printed in 2017, 4 pages.

Delta Scientific Corp., "HD300 High Security All Electric Barrier" Leaflet, printed in 2017, 2 pages.

International Search Report and Written Opinion issued in corresponding PCT Application No. PCT/US2018/059432, dated Feb. 22, 2019, 12 pages.

* cited by examiner

PORTABLE BOLLARD AND BARRICADE SYSTEM

FIELD

The present disclosure relates generally to vehicle barricades.

BACKGROUND

Barricades are commonly deployed to protect individuals and/or property against attack by a vehicle, such as a truck bomb attack. However, conventional barricades such as walls, fences, and concrete highway barriers (e.g., so-called "Jersey barriers") are unsuitable for preventing an attacking vehicle in a 90-degree impact. Some conventional barricades suitable for stopping an attacking vehicle must be cast in place with a deep foundation or secured to a roadway surface. However, excavation or attachment to the roadway surface is both costly and time-consuming, which inhibits rapid deployment of the barricade.

SUMMARY

The present disclosure is directed to various embodiments of a portable bollard for arresting motion of a vehicle. In one embodiment, the portable bollard includes a post, a base plate coupled to the post, a top plate coupled to the post and spaced apart from the base plate along a length of the post, and a tapered member extending from a surface of the top plate facing the base plate to the post. The tapered member tapers from a wider end at the surface of the top plate to a narrower end at the post. The top plate is rotationally offset from the base plate.

The base plate may have a first planform area and the top plate may have a second planform area greater than the first planform area.

A center of gravity of the portable bollard may be above a midpoint of the post.

The tapered member may include a series of ribs spaced around the post or a frusto-conical section. The tapered member may taper at an angle from approximately 25 degrees to approximately 45 degrees relative to a longitudinal axis of the post.

The top plate and the base plate may be square, and corners of the base plate may extend beyond edges of the top plate. The top plate may be rotationally offset from the base plate by an angle of approximately 45 degrees.

A distance between the top plate and the base plate along a length of the post may be from approximately 22 inches to approximately 34 inches.

The portable bollard may include at least one anchor coupled to a second surface of the top plate facing away from the base plate. The at least one anchor defines at least one attachment point for connecting the portable bollard to at least one other portable bollard with a linkage. The portable bollard may include an opening in the at least one anchor and an opening in the top plate aligned with the opening in the at least one anchor. The openings in the at least one anchor and the top plate are configured to receive a fastener for connecting the linkage to the portable bollard. The portable bollard may also include a protective skirt coupled to the second surface of the top plate. The protective skirt extends around the at least one anchor.

The portable bollard may also include a series of gussets extending from the post to a surface of the base plate facing the top plate.

The present disclosure is also directed to various embodiments of a barricade system for arresting motion of a vehicle. In one embodiment, the system includes a series of portable bollards. Each portable bollard includes a post, a base plate coupled to the post, a top plate coupled to the post and spaced apart from the base plate along a length of the post, and a tapered member extending from a surface of the top plate facing the base plate to the post. The tapered member tapers from a wider end at the surface of the top plate to a narrower end at the post. The top plate is rotationally offset from the base plate. The system also includes at least one linkage configured to connect at least two adjacent portable bollards of the series of portable bollards together in an array.

For each portable bollard of the system, the base plate may have a first planform area and the top plate may have a second planform area greater than the first planform area.

For each portable bollard of the system, a center of gravity of the portable bollard may be above a midpoint of the post.

Each portable bollard of the series of portable bollards may also include at least one anchor coupled to a second surface of the top plate facing away from the base plate. The at least one linkage is configured to be coupled to the at least one anchor of each of the plurality of portable bollards.

Each portable bollard may also include an opening in the at least one anchor and an opening in the top plate aligned with the opening in the at least one anchor. The openings in the at least one anchor and the top plate are configured to receive a fastener for connecting the at least one linkage to the portable bollard.

Each portable bollard may also include a protective skirt coupled to the second surface of the top plate. The protective skirt extends around the at least one anchor.

Adjacent portable bollards of the series of portable bollards may be spaced apart by a distance ranging from approximately 14 inches to approximately 28 inches when the adjacent portable bollards are connected together by the linkage.

For each portable bollard, the at least one tapered member may include a series of ribs spaced around the post.

For each portable bollard, the tapered member may taper at an angle from approximately 25 degrees to approximately 45 degrees relative to a longitudinal axis of the post.

For each portable bollard, the top plate and the base plate may be square, and corners of the base plate may extend beyond edges of the top plate. For each portable bollard, the top plate may be rotationally offset from the base plate by an angle of approximately 45 degrees.

This summary is provided to introduce a selection of concepts that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of a portable bollard configured to arrest the forward motion of a vehicle (e.g., an automobile or a truck). The portable bollard according to various embodiments of the present disclosure may be rapidly deployed as a vehicle barricade to protect individuals and/or property against attack by a truck bomb, for instance. The portable bollard of the present disclosure may be rapidly deployed along streets, entrances, or any other wide expanse in which it is desired to protect individuals and/or property against the threat of a vehicle attack. The portable bollard of the present disclosure do not require excavation or attachment to a roadway surface. The portable bollard of the present disclosure may be utilized on concrete, asphalt compressed soil, exposed soil, or vegetation. The present disclosure is also directed to various embodiments of a barricade system including a series of portable bollards connected together in an array by one or more linkages (e.g., chains or cables).

Figure 1A:
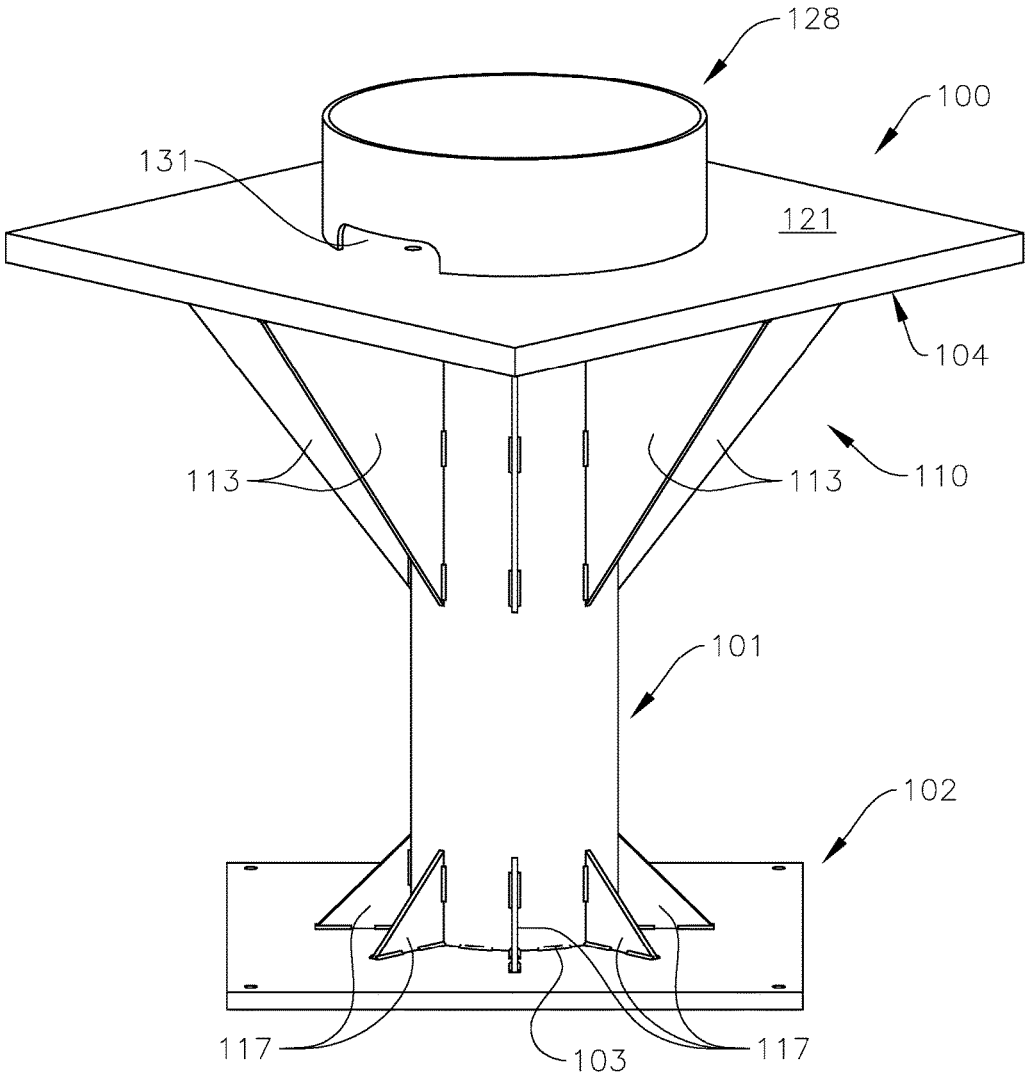
FIGS. 1A-1C are a perspective view, a side view, and a top view, respectively, of a portable bollard according to one embodiment of the present disclosure.
Figure 1B:
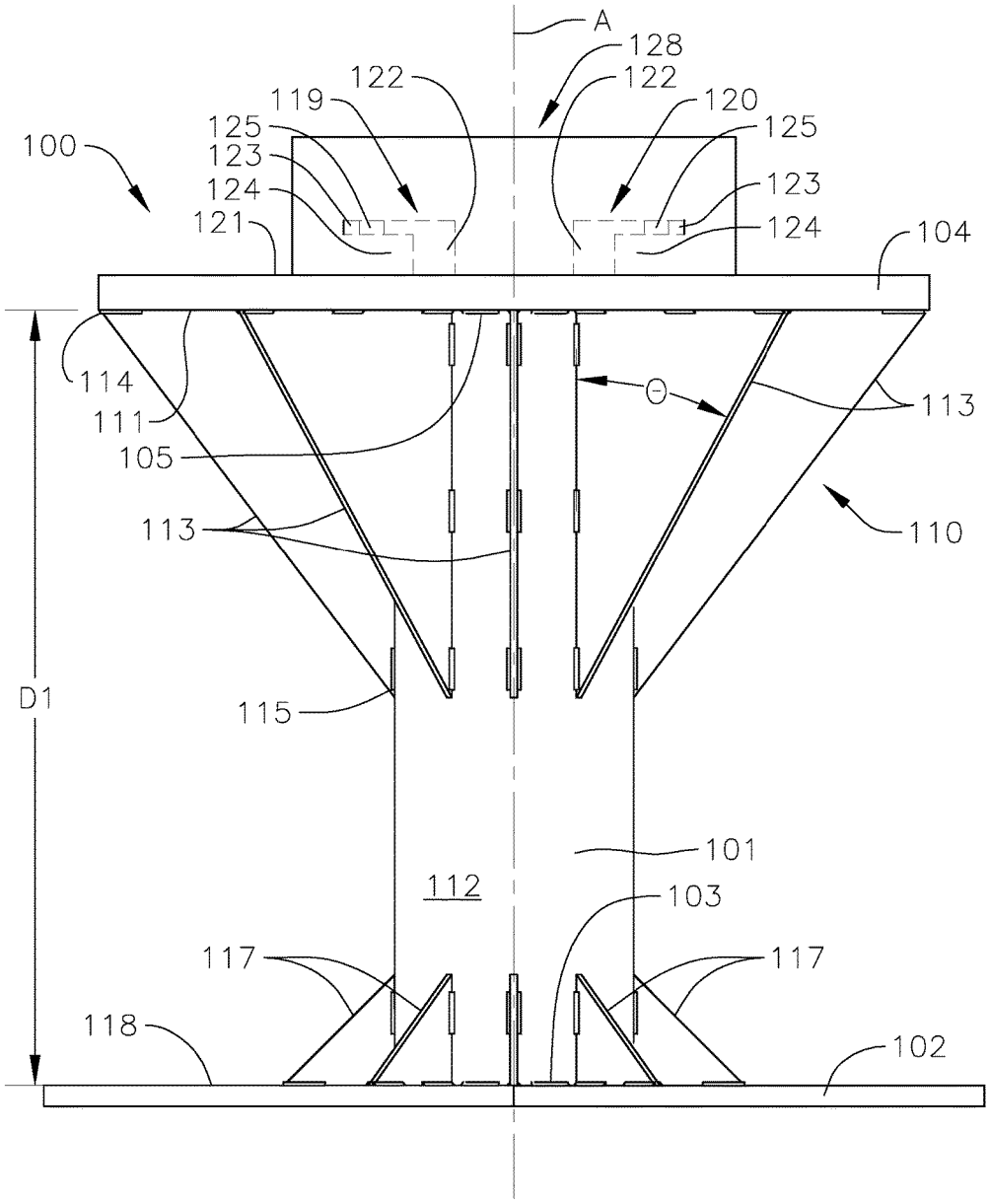
Figure 1C:
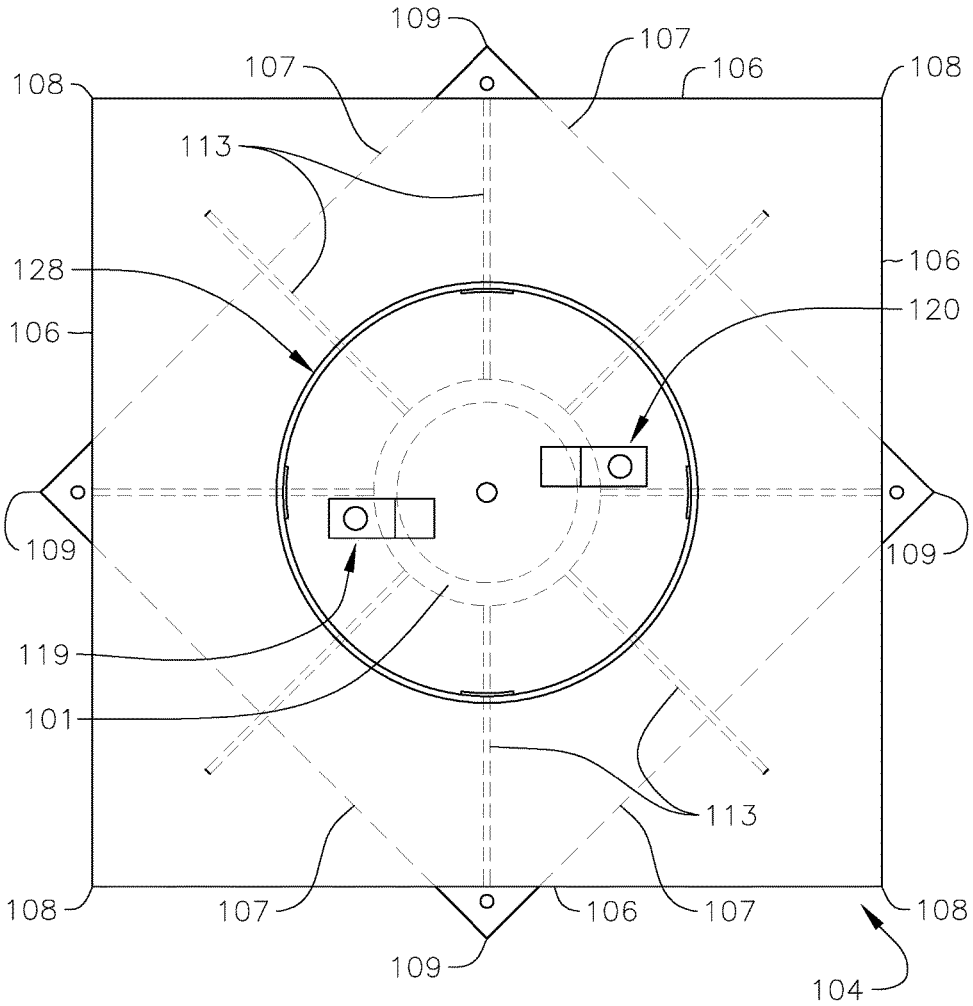
Figure 2B:
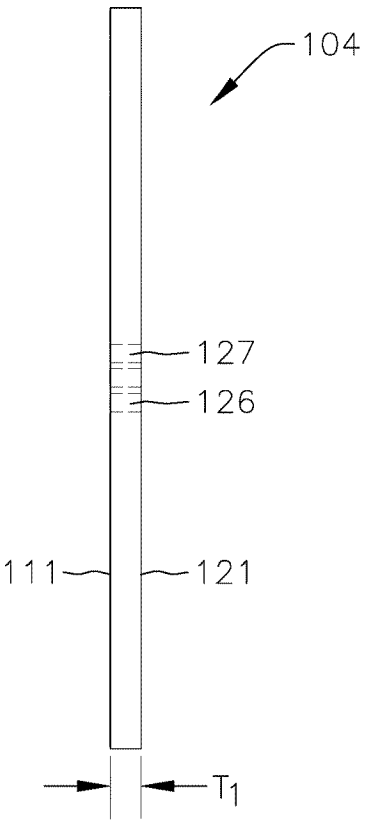
FIGS. 2A-2B are a plan view and a side view, respectively, of a top plate of the portable bollard according to one embodiment of the present disclosure.
Figure 2A:
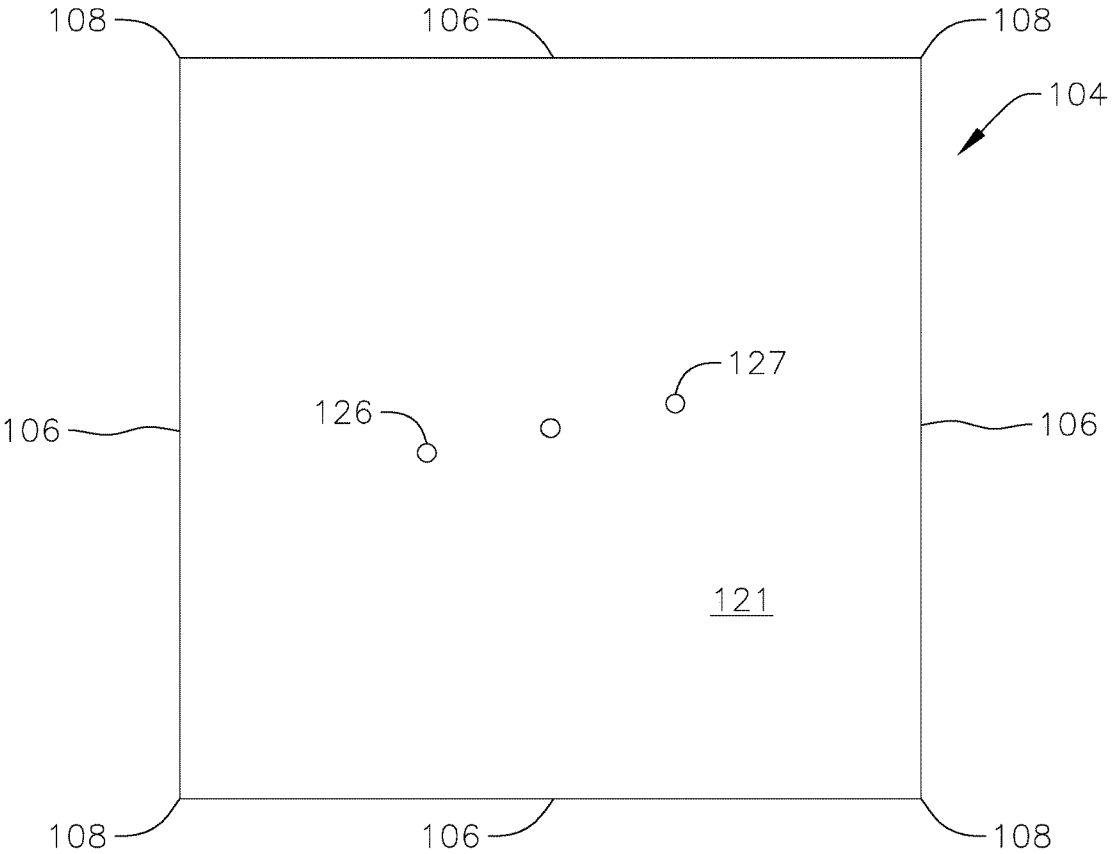
Figure 3A:
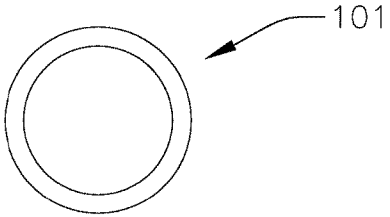
FIGS. 3A-3B are a plan view and a side view, respectively, of a post of the portable bollard according to one embodiment of the present disclosure.
Figure 3B:
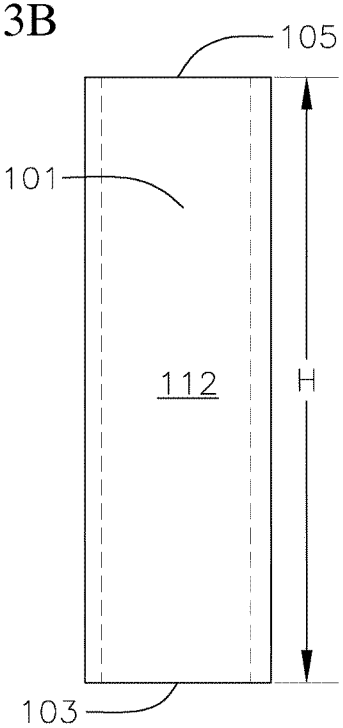
Figure 5A:
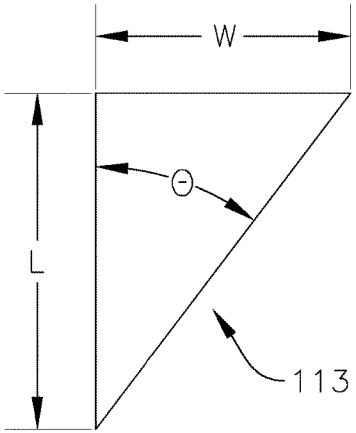
FIGS. 5A-5B are a side view and an end view, respectively, of a rib of the portable bollard according to one embodiment of the present disclosure.
Figure 5B:
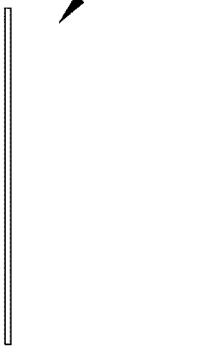
Figure 6A:
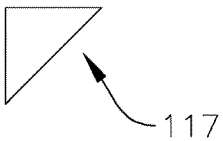
FIGS. 6A-6B are a side view and an end view, respectively, of a gusset of the portable bollard according to one embodiment of the present disclosure.
Figure 6B:
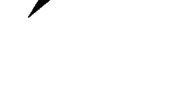
Figure 4B:
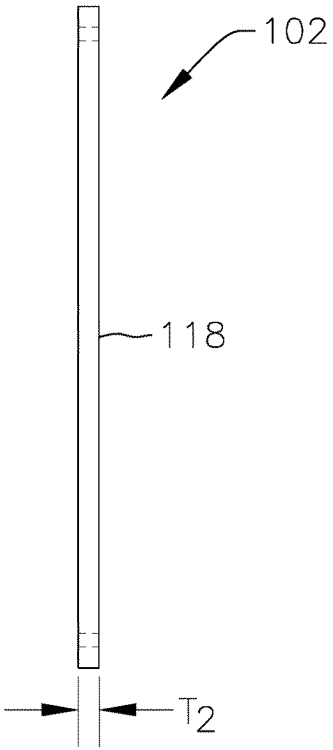
FIGS. 4A-4B are a plan view and a side view, respectively, of a base plate of the portable bollard according to one embodiment of the present disclosure.
Figure 4A:
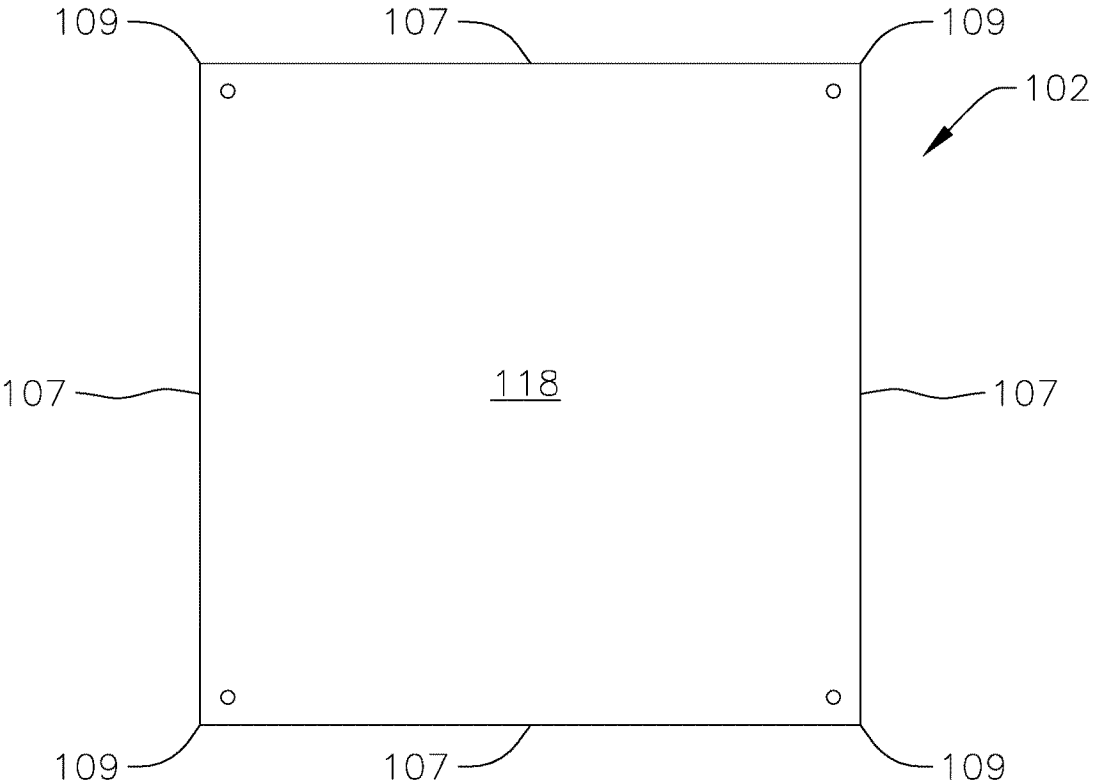
Figure 8A:
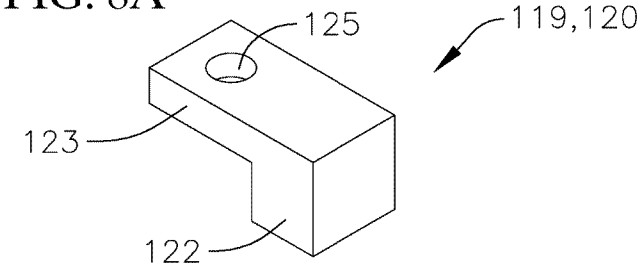
FIGS. 8A-8C are a perspective view, a side view, and a plan view, respectively, of an anchor of the portable bollard according to one embodiment of the present disclosure.
Figure 8B:
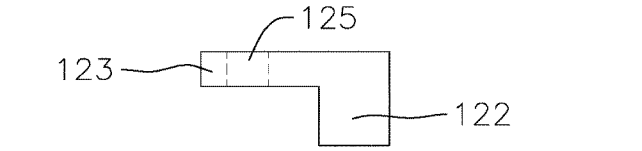
Figure 8C:
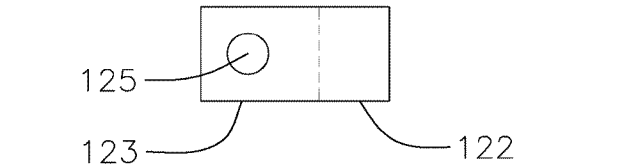
Figure 7A:
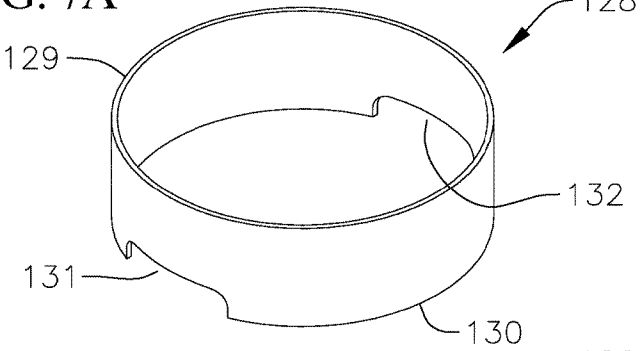
FIGS. 7A-7C are a perspective view, a side view, and a bottom view, respectively, of a protective skirt of the portable bollard according to one embodiment of the present disclosure.
Figure 7B:
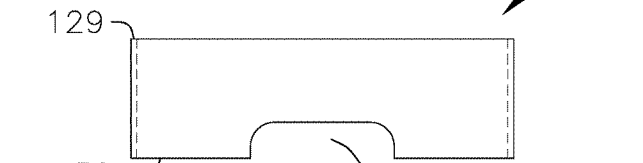
Figure 7C:
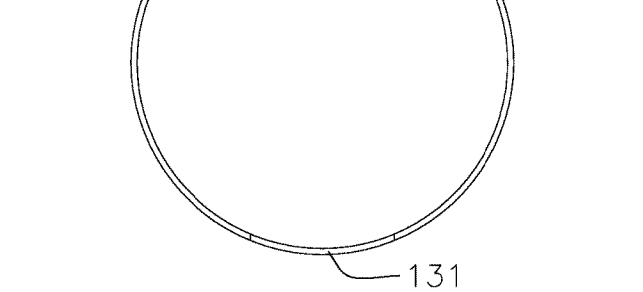

With reference now to FIGS. 1A-1C, a portable bollard 100 according to one embodiment of the present disclosure includes a post 101, a base plate 102 coupled to a first end 103 (e.g., a lower end) of the post 101, and a top plate 104 connected to a second end 105 (e.g., an upper end) of the post 101 opposite the first end. 103 The base plate 102 is configured to be supported on the ground, such as concrete, asphalt compressed soil, exposed soil, or vegetation, and the top plate 104 is configured to be supported off the ground and engage a portion of an attacking vehicle (e.g., a front bumper of the attacking vehicle).

In the illustrated embodiment, the top plate 104 is rotationally offset from the base plate 102. In one or more embodiments, the top plate 104 may be rotationally offset from the base plate 102 by an angle from approximately 30 degrees to approximately 60 degrees. In one embodiment, the top plate 104 is rotationally offset from the base plate 102 by an angle of approximately 45 degrees. In the illustrated embodiment, the top plate 104 and the base plate 102 are square plates that each include four straight edges 106, 107 and four corners 108, 109, respectively, although in one or more embodiments the top plate 104 and the base plate 102 may have any other suitable shapes (e.g., any other suitable prismatic shape). As illustrated in FIG. 1C, the corners 109 of the base plate 102 extend or project beyond the edges 106 of the top plate 104. In one or more embodiments, the top plate 104 and/or the base plate 102 may be provided without sharp corners 108, 109 (e.g., the top plate 104 and/or the base plate 102 may include rounded or blunted corners).

In the embodiment illustrated in FIGS. 1A-1C and 3A-3B, the post 101 is a cylindrical tube. In one or more embodiments, the post 101 may have any other suitable shape, such as, for instance, a cylindrical rod, or a prismatic tube or rod (e.g., a square tube or bar). In one or more embodiments, the post 101 may have an outer diameter from approximately 7 inches to approximately 11 inches (e.g., approximately 8.5 inches) and a wall thickness (e.g., a difference between the outer diameter and an inner diameter) from approximately 0.7 inches to approximately 1.0 inch (e.g., approximately 0.88 inches). Additionally, in one or more embodiments, the post 101 may have a height H from approximately 22 inches to approximately 34 inches. In one embodiment, the height H of the post is approximately 28 inches. In the illustrated embodiment, the top plate 104 and the base plate 102 are coupled to the upper and lower ends 105, 103, respectively, of the post 101 and therefore the distance D between the base plate 102 and the top plate 104 along the length of the post 101 is equal or substantially equal to the height H of the post 101. In one or more embodiments, the height H of the post 101 and the distance D between the top plate 104 and the base plate 102 may be selected depending on the type or types of vehicles the portable bollard 100 is designed to prevent from attack (e.g., the height H of the post 101 and the distance D between the top plate 104 and the base plate 102 may be selected depending on the heights and shapes of the bumpers of the vehicles the portable bollard 100 is configured to prevent from attack). For instance, in one or more embodiments, the height H of the post 101 and the distance D between the top plate 104 and the base plate 102 may be selected such that when the base plate 102 is supported on the ground (e.g., a road or exposed soil), the top plate 104 is spaced above the ground by a distance such that the top plate 104 extends above at least a portion of the bumper of the vehicle that the portable bollard 100 is configured to guard against, the significance of which is described below.

In the embodiment illustrated in FIGS. 1A-1C, 2A-2B, and 4A-4B, the top plate 104 is larger than the base plate 102 (e.g., the top plate 104 has a planform area that is greater than a planform area of the base plate 102). In one or more embodiments, the top plate 104 may have a planform area from approximately 400 $in^2$ to approximately 1600 $in^2$. In the illustrated embodiment, the top plate 104 has a planform area of approximately 900 $in^2$ (e.g., the length of each of the edges 106 of the top plate 104 is approximately 30 in). In one or more embodiments, the base plate 102 may have a planform area from approximately 300 $in^2$ to approximately 900 $in^2$. In the illustrated embodiment, the base plate 102 has a planform area of approximately 576 $in^2$ (e.g., the length of each of the edges 109 of the base plate 102 is approximately 24 in). In one or more embodiments, the thickness $T_1$ of the top plate 104 may be greater than the thickness $T_2$ of the base plate 102. In one or more embodiments, the top plate 104 may have a thickness $T_1$ from approximately 0.75 in to approximately 1.75 in (e.g., approximately 1.25 in). In one or more embodiments, the base plate 104 may have a thickness $T_2$ from approximately 0.5 in to approximately 1.0 in (e.g., approximately 0.75 in). In one or more embodiments, the weight of the top plate 104 is greater than the weight of the base plate 102 due to the greater thickness $T_1$ and/or the greater planform area of the top plate 104 compared to the base plate 102.

In one or more embodiments, the portable bollard 100 may have a total weight from approximately 500 pounds to approximately 1,100 pounds. In one embodiment, the portable bollard 100 has a total weight of approximately 800 pounds. The total weight of the portable bollard 100 may be selected depending, for instance, on the type or types of vehicles the portable bollard 100 is designed to prevent from attack. In one or more embodiments, the top plate 104, the base plate 102, and the post 101 may be formed from any suitably heavy and durable material configured to withstand a vehicle strike, such as, for instance, metal (e.g., steel).

With continued reference to the embodiment illustrated in FIGS. 1A-1C, the portable bollard 100 also includes at least one tapered member 110 extending from a surface 111 of the top plate 104 facing the base plate 102 (e.g., a lower surface 111 of the top plate 104) to an exterior surface 112 of the post 101. In the illustrated embodiment, the tapered member 110 includes a series of ribs 113 each extending from the surface 111 of the top plate 104 to the exterior surface 112 of the post 101. Additionally, in the illustrated embodiment, each of the ribs 113 is a triangular bracket, although in one or more embodiments, the ribs 113 may any other suitable tapered shape. In the embodiment illustrated in FIGS. 1A-1C and 5A-5B, each of the triangular ribs 113 has a length l along the post 101 from approximately 10 inches to approximately 18 inches (e.g., approximately 14 inches) and a width w along the top plate 104 from approximately 7 inches to approximately 13 inches (e.g., approximately 10.6 inches). Additionally, in one or more embodiments, each of the triangular ribs 113 may have a thickness from approximately ⅛ inch to approximately ⅓ inch (e.g., approximately ¼ inch). In the illustrated embodiments, each of the ribs 113 tapers from a relatively wider end 114 at the surface 111 of the top plate 104 to a relatively narrower end 115 at the exterior surface 112 of the post 101. In the illustrated embodiment, the ribs 113 are spaced equidistantly or substantially equidistantly around the post 101. In one or more embodiments, adjacent ribs 113 may be spaced apart by an angle from approximately 30 degrees to approximately 60 degrees (e.g., approximately 45 degrees). Although in the illustrated embodiment, the portable bollard 100 includes eight ribs 113, in one or more embodiments, the portable bollard 100 may include any other suitable number of ribs 113, such as, for instance, less than eight ribs 113 or more than eight ribs 113. Additionally, in one or more embodiments, the tapered member 110 may have any other suitable configuration, such as, for instance, a frusto-conical section tapering between a wider end at the top plate 104 and a narrower end at the post 101. The tapered member 110 (e.g., the one or more ribs 113 or the frusto-conical section) may taper at any suitable angle θ relative to a longitudinal axis A of the post 101, such as, for instance, from approximately 25 degrees to approximately 45 degrees (e.g., approximately 37 degrees). In the illustrated embodiment, the angle θ is defined as the interior angle between an outer surface 116 of the tapered member 110 (e.g., a hypotenuse of the triangular rib 113) and the longitudinal axis A of the post 101. The tapered member 110 (e.g., the one or more ribs 113 or the frusto-conical section) is configured to strengthen and reinforce the connection between the top plate 104 and the post 101. Additionally, as described in more detail below, the tapered member 110 is configured to function as a wedge causing the portable bollard 100 to rotate under an attacking vehicle upon impact. For instance, in one or more embodiments, the portable bollard 100 is configured such that the bumper of an attacking vehicle is configured to contact the top plate 104 and/or the tapered member 110, and the portable bollard 100 is configured to rotate under the attacking vehicle when the top plate 104 and/or the tapered member 110 are struck by the vehicle.

In the embodiment illustrated in FIGS. 1A-1B and 6A-6B, the portable bollard 100 also includes a series of gussets 117 extending between the exterior surface 112 of the post 101 and a surface 118 of the base plate 102 facing the top plate 104 (e.g., an upper surface 118 of the base plate 102). The gussets 117 are configured to strengthen and reinforce the connection between the base plate 102 and the post 101. The gussets 117 may be coupled to the base plate 102 and the post 101 in any suitable manner, such as, for instance, by welding.

With reference to the embodiment illustrated in FIGS. 1B-1C and 8A-8C, the portable bollard 100 also includes a pair of anchors 119, 120 coupled to a surface 121 (e.g., an upper surface opposite the lower surface 111) of the top plate 104 facing away from the base plate 102. The anchors 119, 120 are configured to function as attachment points for linkages (e.g., cable or chain segments) interconnecting two or more portable bollards 100 together into an array (e.g., a daisy chain configuration). In one or more embodiments, the portable bollard 100 may include any other suitable number of anchors 119, 120, such as, for instance, a single anchor or more than two anchors. The anchors 119, 120 may be coupled to the top plate 104 in any suitable manner, such as, for instance, by welding. In one or more embodiments, the anchors 119, 120 may be integrally formed with the top plate. In the illustrated embodiment, each of the anchors 119, 120 includes a standoff 122 connected to the surface 121 of the top plate 104 and a flange or lip 123 extending outward from an upper end of the standoff 122. In the illustrated embodiment, the lip 123 is spaced apart from the surface 121 of the top plate 104 by a gap 124. The gap 124 is configured to accommodate a portion of the linkage (e.g., the chain or cable segment) connecting the portable bollard 100 to one or more portable bollards 100. The size of the gap 124 may be selected depending on the size of the linkage. In one or more embodiments, the gap 124 between the lip 123 of each of the anchors 119, 120 and the surface 121 (e.g., the upper surface) of the top plate 104 may be from approximately 1 inch to approximately 1.5 inches (e.g., approximately 1.25 inches). Additionally, in the illustrated embodiment, the lip 123 extends perpendicular or substantially perpendicular to the standoff 122, and the lip 123 of each of the anchors 119, 120 is parallel or substantially parallel to the surface 121 of the top plate 104.

Additionally, in the illustrated embodiment, the lip 123 of each of the anchors 119, 120 defines an opening 125 (e.g., a through hole) and the top plate 104 defines a pair of openings 126, 127 (e.g., through holes or blind bores). The opening 125 in the lip 123 of each of the anchors 119, 120 is aligned with one of the openings 126, 127 in the top plate 104. Although in the illustrated embodiment the top plate 104 includes a pair of openings 126, 127, in one or more embodiments, the top plate 104 may have any other suitable number of openings 126, 127, depend, for instance, on the number of anchors 119, 120. In the illustrated embodiment, the openings 125 in the lips 123 of the anchors 119, 120 and the openings 126, 127 in the top plate 104 are offset from a centerline of the top plate 104. For instance, in the embodiment illustrated in FIGS. 1C and 2A, one of the openings 126 in the top plate 104 and the opening 125 in the lip 123 of the corresponding anchor 119 are offset in a first direction from the centerline of the top plate 104, and the other opening 127 in the top plate 104 and the opening 125 in the lip 123 of the other anchor 120 are offset in a second direction opposite the first direction from the centerline of the top plate 104. In one or more embodiment, linkages (e.g., cable or chain segments) may be connected to the portable bollard 100 by inserting an eyelet connected to an end of the linkage between the lip 123 of one of the anchors 119, 120 and the surface 121 of the top plate 104, and then inserting a fastener (e.g., a bolt) through the opening 125 in the lip 123 of the anchor 119, 120, through an opening of the eyelet, and through the corresponding opening 126, 127 in the top plate 104.

With reference to the embodiment illustrated in FIGS. 1A-1C and 7A-7C, the portable bollard 100 also includes a protective skirt 128 extending around the pair of anchors 119, 120. The protective skirt 128 is configured to protect the anchors 119, 120 during use of the portable bollard 100. For instance, when two or more portable bollards 100 are connected together with the linkage to create a vehicle barricade (e.g., an array of interconnected portable bollards 100), the protective skirt 128 is configured to protect the anchors 119, 120 of each of the portable bollards 100 against damage due to a vehicle strike. For instance, the protective skirt 128 is configured to protect the anchors 119, 120 of each of the portable bollards 100 when the portable bollards 100 are rotated over (e.g., tipped over) due to a vehicle strike. Otherwise, damage to the anchors 119, 120 could potentially sever the connection between the portable bollards 100, which would reduce the efficacy of the array of portable bollards 100 in arresting the forward motion of the attacking vehicle.

In the illustrated embodiment, the protective skirt 128 is a cylindrical shell (e.g., a cylindrical tube) coupled to the surface 121 (e.g., the upper surface) of the top plate 104 facing away from the base plate 102. In one or more embodiments, the protective skirt 128 may have any other suitable shape, such as, for instance, a prismatic shell (e.g., a square-shaped shell). In the illustrated embodiment, the protective skirt 128 is concentric or substantially concentric with the post 101. In one or more embodiments, the protective skirt 128 may have an outer diameter from approximately 12 inches to approximately 20 inches (e.g., approximately 16 inches). Additionally, in one or more embodiments, the protective skirt 128 may have a wall thickness (e.g., a difference between the outer diameter and an inner diameter) from approximately ⅛ inch to approximately ⅓ inch (e.g., approximately ¼ inch). In the illustrated embodiment, the protective skirt 128 has a height greater than the height of the anchors 119, 120 (e.g., the protective skirt 128 extends above the anchors 119, 120). In one or more embodiments, the protective skirt 128 may have a height measured between upper and lower ends 129, 130 of the protective skirt 128 from approximately 2 inches to approximately 4 inches (e.g., approximately 3 inches).

Additionally, in the illustrated embodiment, the protective skirt 128 defines a pair of opposing pass-through openings 131, 132 at the lower end 130 of the protective skirt 128. In one or more embodiment, the protective skirt 128 may include any other suitable number of pass-through openings 131, 132, depending, for instance, on the number of anchors 119, 120. The pass-through openings 131, 132 are configured to accommodate portions of the linkages connecting the portable bollards 100 together (e.g., the eyelets of the linkages, such as the cables or chains). That is, the pass-through openings 131, 132 are configured to permit ends of the linkages to pass through the protective skirt 128 and connect to the anchors 119, 120. In one or more embodiments, each of the pass-through openings 131, 132 may have a width from approximately 4 inches to approximately 8 inches (e.g., approximately 6 inches) and a height from approximately 1.0 inch to approximately 2.0 inches (e.g., approximately 1.5 inches). The size of the pass-through openings 131, 132 may be selected depending on the size of the ends of the linkages (e.g., the size of the eyelets at the ends of the linkages).

Figure 9A:
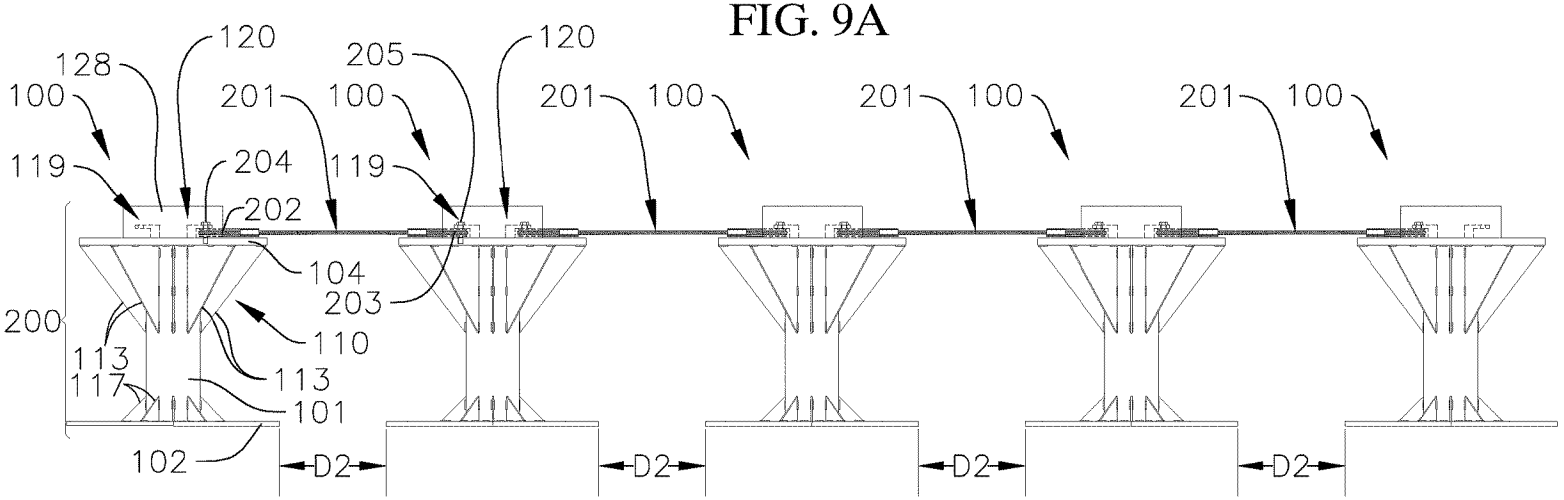
FIGS. 9A-9B are a side view and a top view, respectively, of a series of portable bollards connected together in an array according to one embodiment of the present disclosure.
Figure 9B:
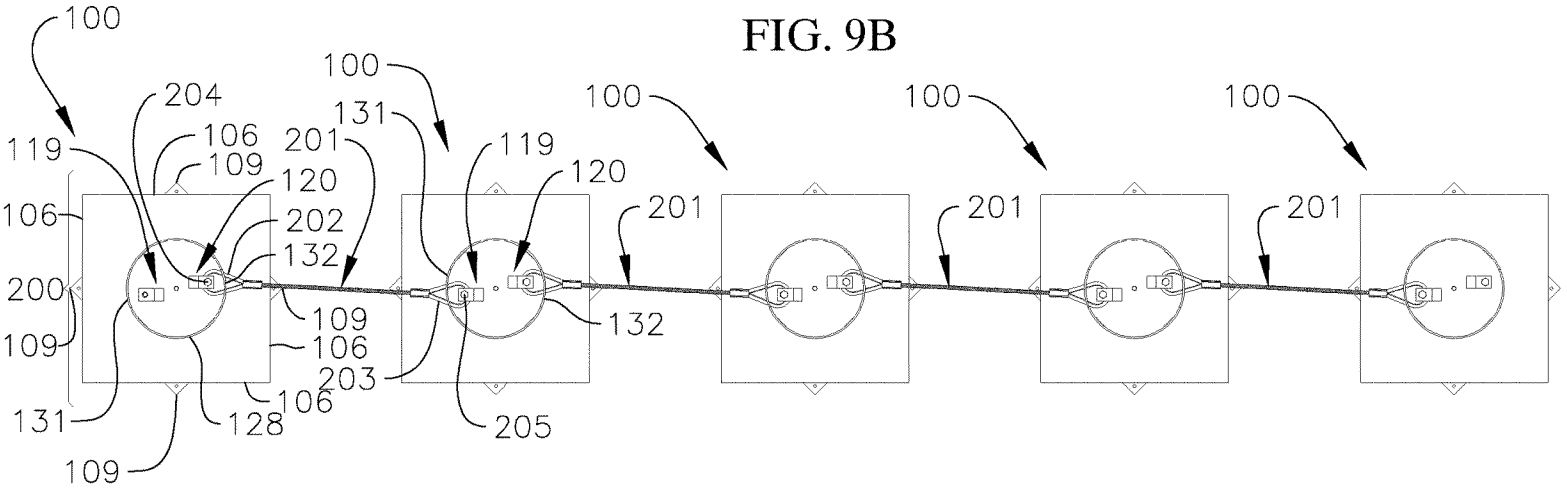

FIGS. 9A-9B depict a series of portable bollards 100 connected together in an array 200 (e.g., a daisy chain configuration) with a series of linkages 201 (e.g., cables, chains, or wire rope slings) extending between adjacent portable bollards 100. The linkages may be made of any suitable material configured to withstand a vehicle strike, such as, for instance, a metal braid (e.g., a steel braid). Although in the illustrated embodiment the array 200 includes five interconnected portable bollards 100, in one or more embodiments, the array 200 may include any other suitable number of portable bollards 100 (e.g., fewer than five or more than five portable bollards 100) depending, for instance, on the type of attacking vehicle the array 200 is configured to protect against and/or the size of the passageway (e.g., street, entrance, or other wide expanse) in which the array 200 is intended to be deployed. In the illustrated embodiment, an eyelet 202 at one end of the each of the linkages 201 is connected to one of the anchors 120 of a first portable bollard 100 by a fastener 204 extending through the opening 125 in the lip 123 of the anchor 120 and the eyelet 202, and into the opening 127 in the top plate 104. An eyelet 203 at an opposite end of each of the linkages 201 is connected to one of the anchors 119 of a second portable bollard 100 adjacent to the first portable bollard 100 by a fastener 205 extending through the opening 125 in the lip 123 of the anchor 119 and the eyelet 203, and into the opening 126 in the top plate 104. Additionally, in the illustrated embodiment, at least a portion of the eyelet 202 at one end of each of the linkages 201 extends or passes through one of the openings 132 in the protective skirt 128, and at least a portion of the eyelet 203 at the other end of each of the linkages 201 extends or passes through the other opening 131 in the protective skirt 128.

Adjacent portable bollards 100 in the array 200 may be spaced apart by any suitable distance depending, for instance, on the type of attacking vehicle the array 200 of portable bollards 100 is configured to protect against and/or the size of the portable bollards 100. In one or more embodiments, adjacent portable bollards 100 are spaced apart by a distance D2 from approximately 14 inches to approximately 28 inches (e.g., approximately 21 inches). In one or more embodiments, the linkages 201 (e.g., cables, chains, or wire rope slings) connecting the adjacent portable bollards 100 together may have a length from approximately 35 inches to approximately 49 inches (e.g., approximately 42 inches). In one or more embodiments, the distance D2 between adjacent portable bollards 100 may be less than or equal to the width of each of the portable bollards 100 (e.g., less than or equal to a width of the base plate 102 and/or a width of the top plate 104). In one or more embodiments, the distance D2 between adjacent portable bollards 100 may be greater than the width of each of the portable bollards 100 (e.g., greater than the width of the top plate 104 and/or the width of the base plate 102). Additionally, the thickness of the linkages 201 (e.g., cables, chains, or wire rope slings) may be selected depending on the desired properties of the linkages 201 (e.g., tensile strength) and the type or types of vehicles the array 200 is designed to stop. In one or more embodiments, the linkages 201 may have a thickness from approximately ⅜ inch to approximately ⅞ inch (e.g., approximately ⅝ inch).

The Appendix attached to the present disclosure includes screenshots from a video showing operation of the array 200 of interconnected portable bollards 100 in arresting the motion of a truck. In operation, when the single portable bollard 100, or the array 200 of two or more portable bollards 100 connected together with one or more linkages 201, is utilized to arrest the forward motion of a vehicle, the tapered member 110 (e.g., the one or more ribs 113) of at least one of the portable bollards 100 is configured to contact the bumper of the attacking vehicle. When the tapered member 110 contacts the bumper of the vehicle, the tapered member 110 functions as a wedge causing portable bollard 100 to rotate over (e.g., tip over). Additionally, in one or more embodiments, the top plate 104 is heavier than the base plate 102 (e.g., due to the larger planform area and/or the greater thickness $T_1$ of the top plate 104 compared to the base plate 102), which aids in rotating the portable bollard 100 when portable bollard 100 is struck by a vehicle. In one or more embodiments, a center of gravity (cg) of the portable bollard 100 may be above a center of volume of the portable bollard 100 and/or above a midpoint of the post 101, which aids in rotating the portable bollard 100 when portable bollard 100 is struck by a vehicle. For instance, in one or more embodiments, the center of gravity of the portable bollard 100 may be spaced greater than half the distance D between the top plate 104 and the base plate 102 above the base plate 102 (i.e., greater than D/2 above the base plate 102). In one or more embodiments, the center of gravity of the portable bollard 100 may be at least approximately ⅔ the distance D between the top plate 104 and the base plate 102 above the base plate 102 (e.g., approximately ⅔ the height of the post 101) or at least approximately ¾ the distance D between the top plate 104 and the base plate 102 above the base plate 102 (e.g., approximately ¾ the height of the post 101). In one or more embodiments, locating the center of gravity of the portable bollard 100 above the center of volume of the portable bollard 100 and/or above the midpoint of the post 101 may be achieved by attaching one or more weights proximate to the top plate 104 (e.g., above the midpoint of the post 101), selecting different materials for the top plate 104 and the base plate 102 (e.g., selecting a heavier material for the top plate 104 than the base plate 102), selecting different sizes for the top plate 104 and the base plate 102 (e.g., selecting a larger size for the top plate 104 than the base plate 102), and/or any other suitable method. As the portable bollard 100 rotates over, the portable bollard 100 becomes lodged or trapped under the front end of the vehicle (e.g., the front axle or the front of the frame), which tends to lift the front end of the vehicle off the ground if the vehicle is traveling at a sufficiently high speed. Lifting the front end of the vehicle redirects the momentum of the vehicle upward and thereby arrests the forward motion of the vehicle. In one or more embodiments, the portable bollard 100 is configured to rotate over when contacted by a vehicle traveling at a speed from approximately 1 mph to approximately 1.5 mph or greater.

Additionally, as described above, the top plate 104 is rotationally offset relative to the base plate 102 (e.g., offset by approximately 45 degrees). Accordingly, the portable bollard 100 presents an edge (e.g., one of the straight edges 106, 107 of the top plate 104 or the base plate 102) and a sharp corner (e.g., one of the corners 108, 109 of the top plate 104 or the base plate 102) to an attacking vehicle regardless of the approach angle of the attacking vehicle relative to the portable bollard 100. Additionally, the angular offset between the top plate 104 and the base plate 102 is configured to index (i.e., reorient) the portable bollard 100 into an effective orientation for arresting the forward motion of an attacking vehicle when the portable bollard 100 is struck by the attacking vehicle. For instance, in one or more embodiments, the angular offset between the top plate 104 and the base plate 102 is configured to index (i.e., reorient) the portable bollard 100 such that one of the edges 106 of the top plate 104 and one of the corners 109 of the base plate 102 engages the ground (e.g., the roadway or the exposed soil) when the portable bollard 100 is rotated over due to contact with an attacking vehicle. In this manner, the portable bollard 100 is configured to effectively stop and/or disable an attacking vehicle regardless of the approach angle of the attacking vehicle relative to the portable bollard 100.

Additionally, when the single portable bollard 100, or at least one portable bollard 100 in the array 200 of two or more interconnected portable bollards 100, is struck by a vehicle, the one or more portable bollards 100 are configured to land in front of or under the vehicle, which further aids in arresting the forward motion of the vehicle. Moreover, the initial contact between the vehicle and the one or more portable bollards 100 is configured to reduce the momentum and the forward motion of the vehicle due to the weight of the portable bollard 100.

The array 200 of interconnected portable bollards 100 is configured to arrest the forward motion of the attacking vehicle in several ways in addition to the function of the individual portable bollard 100 described above. For example, the array 200 of portable bollards 100 combines the masses of each of the individual portable bollards 100 and this combined mass is configured to reduce the momentum of the attacking vehicle during the initial collision between the attacking vehicle and the array 200 of portable bollards 100. Additionally, the portable bollards 100 in the array 200 are configured to wrap around at least a portion of the attacking vehicle, which is configured to control the direction of the vehicle and limit its maneuverability. Furthermore, the array 200 of interconnected portable bollards 100 is configured to prevent the portable bollards 100 from being displaced away from the attacking vehicle on impact and thereby retain the portable bollards 100 in front of the attacking vehicle. The linkages 201 interconnecting the portable bollards 100 are also configured to function together as a fence line that aids in arresting the forward motion of the attacking vehicle. Additionally, as one portable bollard 100 is contacted by the attacking vehicle (e.g., as one of the portable bollards 100 rotates over due to contact with the attacking vehicle), the force of the impact is transferred via the linkages 201 to the other portable bollards 100, which pulls these portable bollards 100 into contact with the attacking vehicle to further aid in arresting the forward motion of the attacking vehicle. Moreover, during impact between an attacking vehicle and the array 200 of interconnected portable bollards 100, the array 200 is configured to trap one or more of the portable bollards 100 under the attacking vehicle (e.g., under the front axle or forward portion of the frame) and thereby lift at least a portion of the attacking vehicle off the ground, which redirects the energy vector of the attacking vehicle upward and reduces the forward motion of the attacking vehicle.

Similarly, the interconnected portable bollards 100 of the array 200 also form a relatively large obstacle for the attacking vehicle to land on, which inhibits the attacking vehicle from rolling and making further progress.

The single portable bollard 100 and/or the array 200 of interconnected portable bollards 100 of the present disclosure may be used in conjunction with other barrier or barricade systems, such as, for instance, an active vehicle barrier (e.g., the Delta Scientific Corporation MP5000 portable barricade).

A single portable bollard 100 according to one or more embodiments of the present disclosure are configured to stop and disable a four door passenger car traveling at approximately 20 mph or a 10,000 pound diesel truck traveling at approximately 20 mph. An array 200 of three interconnected portable bollards 100 according to one embodiment of the present disclosure is configured to stop and disable a 10,000 pound diesel truck traveling at approximately 30 mph. An array 200 of five interconnected portable bollards 100 according to one embodiment of the present disclosure is configured to stop and disable a 15,000 pound diesel truck traveling at approximately 30 mph. The portable bollards 100 and the arrays 200 of interconnected portable bollards 100 according to one or more embodiments of the present disclosure are configured to achieve certification of M30, P3 per ASTM F2656-15 testing methodology.

In one or more embodiments, the portable bollard 100 and/or the array 200 of interconnected portable bollards 100 may include one or more safety lights, signage (e.g., warning signs), and/or sign posts. Additionally, in one or more embodiments, the portable bollard 100 and/or the array 200 of interconnected portable bollards 100 may include one or more decorative features, such as, for instance, balls and/or spheres to match the local architecture of the location in which the portable bollard 100 or the array 200 of interconnected portable bollards 100 is deployed.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "substantially," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A portable bollard for arresting motion of a vehicle, the portable bollard comprising:

a post;

a base plate having a plurality of sides coupled to the post;

a top plate having a plurality of sides coupled to the post and spaced apart from the base plate along a length of the post; and a tapered member extending from a surface of the top plate facing the base plate to the post, wherein the tapered member tapers from a wider end at the surface of the top plate to a narrower end at the post, and wherein the top plate is rotationally offset from the base plate.

2. The portable bollard of claim 1, wherein the base plate has a first planform area and the top plate has a second planform area greater than the first planform area.

3. The portable bollard of claim 1, wherein a center of gravity of the portable bollard is above a midpoint of the post.

4. The portable bollard of claim 1, wherein the tapered member comprises a plurality of ribs spaced around the post.

5. The portable bollard of claim 1, wherein the tapered member comprises a frusto-conical section.

6. The portable bollard of claim 1, wherein the tapered member tapers at an angle anywhere from approximately 25 degrees to approximately 45 degrees relative to a longitudinal axis of the post.

7. The portable bollard of claim 1, wherein the top plate and the base plate are square, and wherein corners of the base plate extend beyond edges of the top plate.

8. The portable bollard of claim 7, wherein the top plate is rotationally offset from the base plate by an angle of approximately 45 degrees.

9. The portable bollard of claim 1, further comprising at least one anchor coupled to a second surface of the top plate facing away from the base plate, the at least one anchor defining at least one attachment point for connecting the portable bollard to at least one other portable bollard with a linkage.

10. The portable bollard of claim 9, further comprising:

an opening in the at least one anchor; and an opening in the top plate aligned with the opening in the at least one anchor, the openings in the at least one anchor and the top plate configured to receive a fastener for connecting the linkage to the portable bollard.

11. The portable bollard of claim 9, further comprising a protective skirt coupled to the second surface of the top plate, the protective skirt extending around the at least one anchor.

12. The portable bollard of claim 1, further comprising a plurality of gussets extending from the post to a surface of the base plate facing the top plate.

13. A barricade system for arresting motion of a vehicle, the system comprising:

a plurality of portable bollards, each portable bollard of the plurality of portable bollards comprising:

a post;

a base plate having a plurality of sides coupled to the post;

a top plate having a plurality of sides coupled to the post and spaced apart from the base plate along a length of the post; and a tapered member extending from a surface of the top plate facing the base plate to the post, wherein the tapered member tapers from a wider end at the surface of the top plate to a narrower end at the post, and wherein the top plate is rotationally offset from the base plate; and at least one linkage configured to connect at least two adjacent portable bollards of the plurality of portable bollards together in an array.

14. The system of claim 13, wherein, for each portable bollard, the base plate has a first planform area and the top plate has a second planform area greater than the first planform area.

15. The system of claim 13, wherein, for each portable bollard, a center of gravity of the portable bollard is above a midpoint of the post.

16. The system of claim 13, wherein:

each portable bollard of the plurality of portable bollards further comprises at least one anchor coupled to a second surface of the top plate facing away from the base plate, the at least one linkage is configured to be coupled to the at least one anchor of each of the plurality of portable bollards.

17. The system of claim 13, wherein each portable bollard further comprises:

an opening in the at least one anchor; and an opening in the top plate aligned with the opening in the at least one anchor, the openings in the at least one anchor and the top plate configured to receive a fastener for connecting the at least one linkage to the portable bollard.

18. The system of claim 16, wherein each portable bollard further comprises a protective skirt coupled to the second surface of the top plate, the protective skirt extending around the at least one anchor.

19. The system of claim 13, wherein, for each portable bollard, the tapered member comprises a plurality of ribs spaced around the post.

20. The system of claim 13, wherein:

for each portable bollard, the top plate and the base plate are square, and corners of the base plate extend beyond edges of the top plate, and for each portable bollard, the top plate is rotationally offset from the base plate by an angle of approximately 45 degrees.

21. The portable bollard of claim 1, wherein the tapered member tapers linearly from the surface of the top plate to the post.

22. The portable bollard of claim 1, wherein the tapered member continuously tapers from the surface of the top plate to the post.

23. The system of claim 13, wherein each bollard tapered member tapers linearly from the surface of the plate to the post.

24. The system of claim 13, wherein each bollard tapered member continuously tapers from the surface of the plate to the post.

* * * * *